US006794593B2

(12) United States Patent
Kraenzler et al.

(10) Patent No.: US 6,794,593 B2
(45) Date of Patent: Sep. 21, 2004

(54) ELECTRIC HAND POWER TOOL WITH SWITCHING KEY

(75) Inventors: Ernst Kraenzler, Leinfelden-Echterdingen (DE); Peter Stierle, Waldenbuch (DE); Harald Krondorfer, Ludwigsburg (DE); Ralph Dammertz, Stuttgart (DE); Ralph Beetz, Penang (MY); Mario Pauli, Gundelsheim (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 10/253,267

(22) Filed: Sep. 24, 2002

(65) Prior Publication Data

US 2003/0062250 A1 Apr. 3, 2003

(30) Foreign Application Priority Data

Sep. 29, 2001 (DE) ..... 201 16 066 U

(51) Int. Cl.[7] ..... H01H 9/20

(52) U.S. Cl. ..... 200/522; 200/321; 200/332.2

(58) Field of Search ..... 200/332.2, 522, 200/321, 322, 327

(56) References Cited

U.S. PATENT DOCUMENTS 3,881,081 A * 4/1975 Schilling et al. ..... 200/522
4,250,366 A * 2/1981 Erickson et al. ..... 200/332.2

* cited by examiner

*Primary Examiner*—Renee Luebke
(74) *Attorney, Agent, or Firm*—Michael J. Striker

(57) ABSTRACT

An electric hand power tool has an on/off switch, an elongated switching key having a front end and a rear end and actuating the switch, a blocking lever carried by and projecting from the switching key to prevent or to allow turning on of the latter, the switching key being supported turnably, the switching key having a convex curvature starting substantially centrally and extending toward the rear end, the switching key carrying the blocking lever near the rear end, the blocking lever having an upper edge located under a tangent between the convex curvature and the rear end of the switching key.

8 Claims, 2 Drawing Sheets

ELECTRIC HAND POWER TOOL WITH SWITCHING KEY

BACKGROUND OF THE INVENTION

The present invention relates to an electric hand power tool with a switching key.

Electric hand power tools with elongated switching keys are known. They can be operated with several finger simultaneously and therefore In a force-saving and comfortable manner. They extend parallel to the longitudinal axis of the motor housing. The front end of the switching key is supported rotatably in the motor housing so that the rear end is turnable for turning on of the motor in the motor housing.

The known switching keys carry a centrally projected turnable blocking lever. When this blocking lever is turned then the switching key can be pressed to its turning-on position, so that then the motor of the hand power tool can be set in operation. When the blocking lever is not turned rearwardly, the switching key is not movable to its turning-on position even with application of considerable force.

The outer contour of the known switching key extends flatly and is not adapted to the operator hand. After long operational time the hand power tool is not convenient to operate, also since the blocking lever turned to its releasable position extends as the contour of the switching key and thereby interferes with the operator hand. Moreover, the exposed blocking lever has a tendency to break because In rough operations it Is not protected from impacts and strikes, in particular when they occur frequently. If the blocking lever is broken, the hand power tool either can not be turned or can be unintentionally turned on due to failure of the turning-on lock, with a considerable risk of accidents.

SUMMARY OF THE INVENTION

Accordingly, it is an object of the present invention to provide a hand power tool which avoids the disadvantages of the prior art.

More particularly, it is an object of the present invention to provide a hand power tool which has be advantage that due to the convex curvature provided on the rear end of the switching key, in particular its use over a long time, comfortable and reliable operation is provided.

In keeping with these objects and with others which will become apparent hereinafter, one feature of the present invention resides, briefly stated, in an electric hand power tool which has an on and off switch, an elongated switching key having a front end and a rear end actuating the switch, a projecting blocking lever which manually sets a turning lock out of operation, the switching key being supported turnably, the switching key having a concave curvature starting substantially centrally and extending toward a rear end, and the switching key carries the blocking lever near the rear end.

When the hand power tool is designed in accordance with the present Invention, due to the convex curvature arranged at the rear end of the switching key, during its use in particular over a long time, a comfortable and reliable operation is provided.

The blocking lever can be located on the rear end of the switching key. Therefore a greater, free supporting surface of the finger of the operator is provided.

The convex curvature at the rear end of the switching key can merge into a concave curvature. Therefore the operator hand can hold the switching key in a particularly reliable and comfortable manner The blocking lever can be provided at the deepest point of the concave curvature of the switching key. Therefore, the blocking lever can be turnable comfortably by the operator hand to its release position and well protected against breaking by Impacts and strikes.

The concave curvature can have the recess which corresponds to a negative form or an imprint of the blocking lever. Therefore the blocking lever moves into this recess in its release position flush and improves the comfort for the operator head.

The switching key in the region of its convex curvature can carry a plurality of small calotte-shaped depressions. This improves the gripping of the switching key.

The blocking lever can be arranged turnably to the rear end of the switching key. Therefore an error-free operation is guaranteed.

The housing outer contour in the region of the switching key can extend as a concave curvature. In this construction the rear end of the switching key extends relative to the housing further outwardly than the front end. This provides an especially comfortable, force-reducing operation of the switching key.

In accordance with another feature, a raised actuation arrow can point in the turning direction of the blocking lever and is arranged near the switching key. Therefore a failure-free operation of the blocking lever and the switching key is guaranteed.

The blocking lever can be curved in the same direction to the concave curvature of the switching key. Thereby the recess for insertion in the outer contour of the switching key is very small and improves the operator comfort.

An important advantage of the present invention is the protected arrangement of the turning-on blocking lever in the concave "trough" of the switching key. Both its front concave region and also its rear edge extend outwardly beyond the upper edge of the blocking lever. It provides two supporting points at opposite sides in the immediate vicinity to the blocking lever, which are located higher than the upper edge of the blocking lever and therefore can take the force. Thereby in the case of mistaken actuation of the device the turning-on blocking lever is not damaged. Furthermore, due to this arrangement the blocking lever can not be actuated, for example when the device is pulled on the cable over the work bench.

The novel features which are considered as characteristic for the present invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF THE PREFERRED EMBODIMENTS

Figure 1:
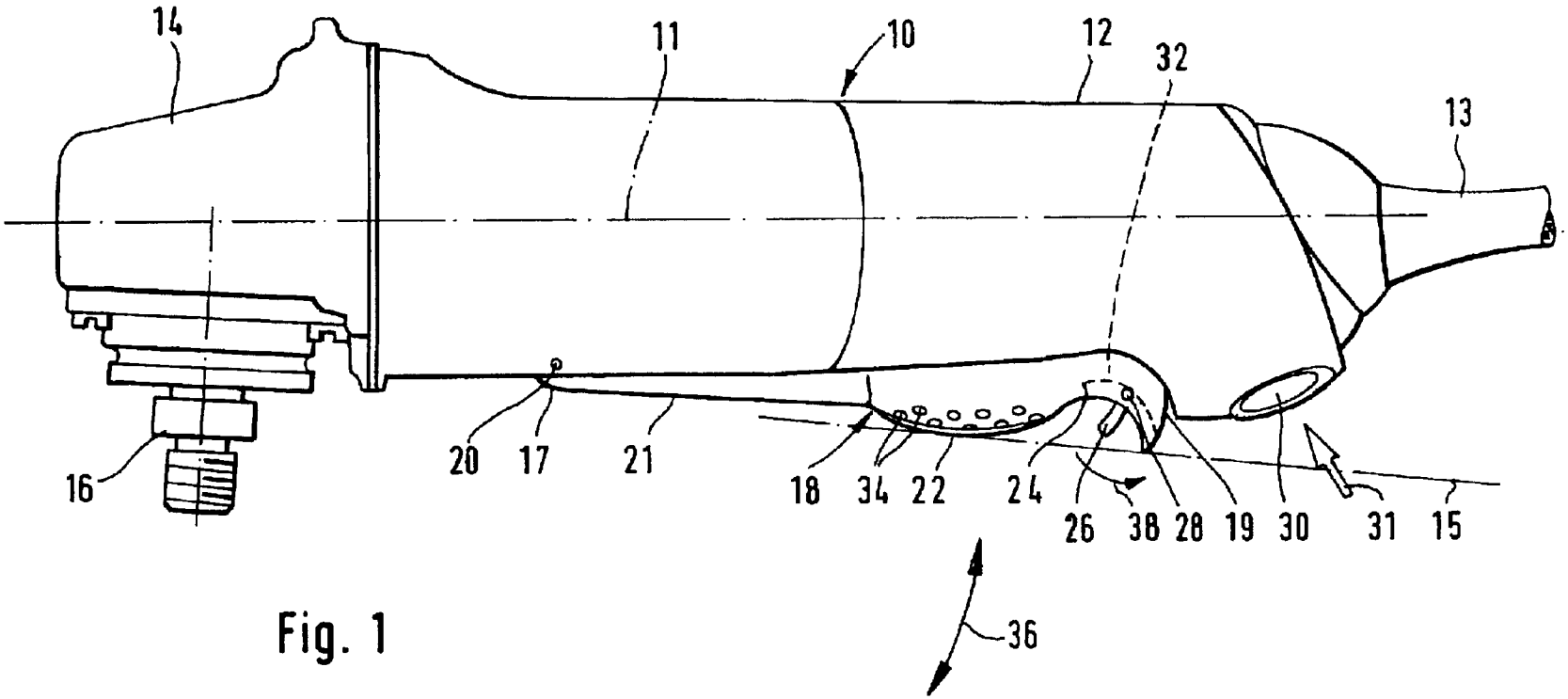
FIG. 1 is a side view of an electric hand power tool in accordance with the present invention.

FIG. 1 shows a side view of an electric hand power tool 10 formed as an angle grinder. It has, at the right side in an observation direction, a motor housing 12, with an electric cable 13 at its rear end for power supply of a not shown motor which is received in the motor housing 12. A transmission housing 14 is located forwardly on the electric hand power tool 10. It contains a not shown angular transmission, with a drive shaft 16 extending perpendicularly to the longitudinal axis 11 of the motor housing 12 and exiting downwardly from the angle transmission housing 14.

The electric hand power tool 10 at its lower side is provided with an elongated switching key 18. It is turnable inwardly into the housing 12 in correspondence with a movement arrow 36 around a turning axis 20 located at the front end 17.

At the center of the switching key 18, its straight extending contour 21 merges into an outwardly curved or convex contour or curvature 22. This convex contour 22 merges at the rear end 19 of the switching key 18 into an inwardly extending or concave contour or curvature 24, which ends at the rear end 19 above the highest point of the convex curvature 22.

A blocking lever 26 is arranged near the deepest point of the concave curvature 24. In its blocking position it projects inclinedly to the left toward the longitudinal axis 11 of the hand power tool 10, and it is turnable around its turning axis 28 to the rear end 19.

The concave curvature 24 in the region of the blocking lever 26 has a depression 32 which corresponds to a negative form of the blocking lever 26. The depression 32 is shown in FIG. 1 in a broken line and in FIG. 2 in a solid line. Thereby the blocking lever 26 which is turnable in direction of the actuating arrow 38 can be introduced into the outer contour of the concave curvature 24 flush with it. Thereby it does not interfere with the operator operator's hand during pressing down of the switching key 18.

Moreover, the blocking lever 26 in a normal position, or in other words in the OFF position of the switching key 18, due to its arrangement in a tough-shade depression formed by the non e curvature 24, can not be reached by mistake with shoe soles and thereby is especially secure from damages which frequently occur in construction operations. This feature Is illustrated by a shown tangent 15 which contacts the both highest points of the contour of the switching key 18 over the depression 24.

At the right side, as considered In the observation direction, an arresting key 30 is provided near the rear end 19 of the switching key 18. It is pressable in direction of the movement arrow 31 into the interior of the motor housing 12 when the switching key 18 is actuated to its turning on position.

When the arresting key 30 after pressing down of the switching key 18 is activated, it is held in its turning on position. Therefore the blocking lever 26 remains turned into the contour of the concave curvature 24 and thereby there is no danger that the blocking lever 28 breaks during handling of the electric hand power tool 10 by an operator.

The blocking lever 26 is curved in the same direction toward the depression formed by the concave curvature 24. Therefore it is introduced in the recess 32 completely flush and contour-identically, so that it can be smaller than in the case of a straight-shaped blocking lever.

The switching key 18, similarly to a golf ball, carries a calotte-shaped small depression 34 in the region of the convex curvature 22. This improves the gripping for the operator hand in the actuating region of the switching key 18 and makes this region especially well feelable.

Figure 2:
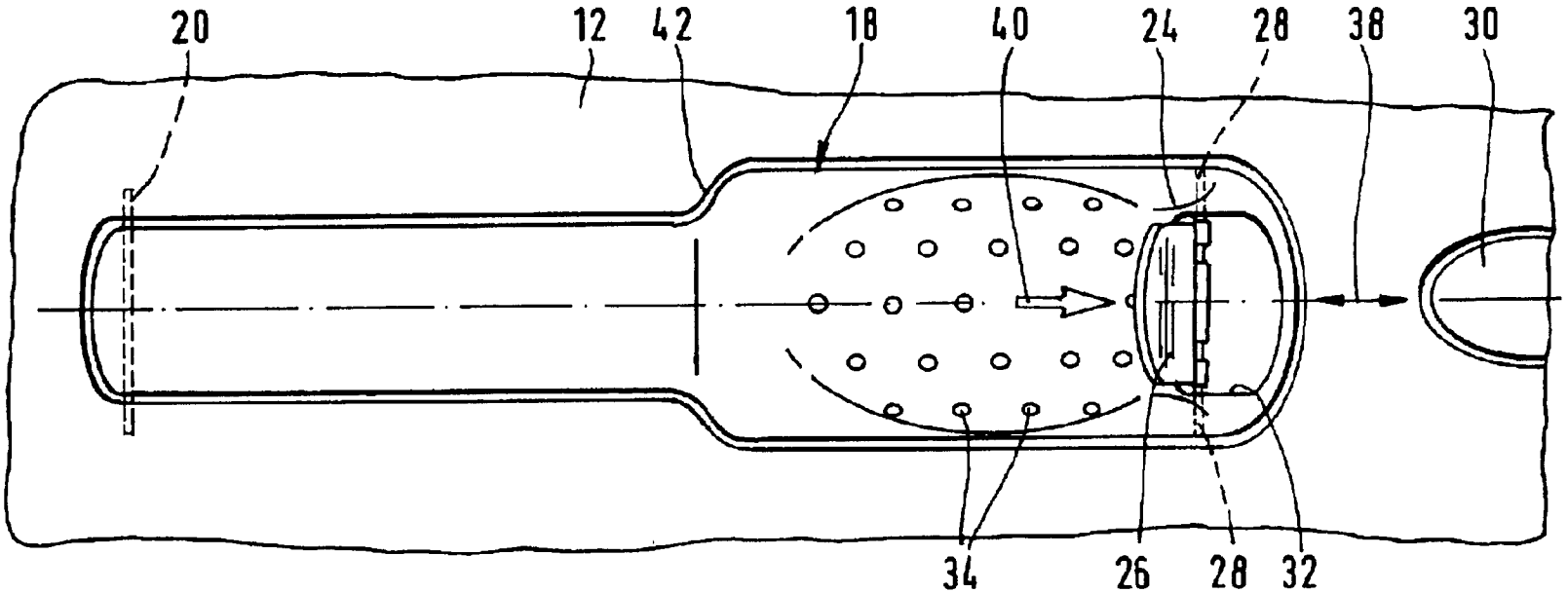
FIG. 2 is a plan view on a switching key with a section of the lower side of the inventive hand power tool.

FIG. 2 shows a bottom view of the motor housing 12 with the switching key 18, while from FIG. 1 it can be seen especially clear how the recess 32 extends for insertion of the blocking lever 26. The turning axis 28 of the blocking lever 26 is located in the deepest region of the concave curvature 24.

An actuating arrow 40 is provided for identification of the turning direction of the blocking lever 26. It is located centrally in the switching key 18 and is formed as a raised formation.

The present invention provides the same advantages for pressure air operating hand power tools or hand power tools operated from other sources.

In a not shown embodiment of the invention, instead of the actual bodily formed rotary axis, a virtual rotary axis can be provided for turning the switching key around it. It operates so that the switching key engages the housing with its front end and is clamped in it. It is supported with elastic pros and is turnable within a range of a gap provided by the housing shape.

It will be understood that each of the elements described above, or two or more together, may also find a useful application in other types of constructions differing from the types described above.

While the invention has been illustrated and described as embodied in electric hand power tool with switching key, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is:

1. An electric hand power tool, comprising an on/off switch; an elongated switching key having a front end and a rear end actuating said switch; a blocking lever carried by and projecting from said switching key to prevent or to allow turning on of the switch, said switching key being supported turnably, said switching key having a convex curvature starting substantially centrally and extending toward said rear end, said switching key carrying said blocking lever near said rear end, said blocking lever having an axially outer edge which is always located axially under a tangent between said convex curvature and said rear end of said switching key and never extends axially outwardly beyond the tangent.

2. An electric hand power tool as defined in claim 1, wherein said convex curvature merges towards said rear end into a concave curvature.

3. An electric hand power tool as defined in claim 2, wherein said concave curvature carries said blocking lever near an axially deepest region of said concave curvature.

4. An electric hand power tool as defined in claim 2, wherein said concave curvature in a turning region of said blocking lever has a depression which corresponds to a negative shape of said blocking lever and in which said blocking lever ran descend by turning inwardly.

5. An electric hand power tool as defined in claim 4, wherein said blocking lever is shorter than a distance between said depression and two axially outermost points of a contour of said switching key and is curved in a same direction as said concave curvature.

6. An electric hand power tool as defined in claim 2, wherein said switching key in a region of said convex curvature has several small calotte-shaped depressions for improving gripping for an operator hand.

7. An electric hand power tool as defined in claim 2, wherein said switching key in a region of said convex curvature carries centrally a raised arrow with a direction facing a correct turning movement of said blocking lever to its release position.

8. An electric hands power tool as defined in claim 1, wherein said blocking lever is supported turnably around a turning axis located near said rear end of said switching key.

* * * * *